United States Patent [19]

Beyl et al.

[11] Patent Number: 4,508,360

[45] Date of Patent: Apr. 2, 1985

[54] SKI BRAKE

[75] Inventors: Jean Beyl; Jean Bernard, both of Nevers; René Guérreau, Montmarault; Daniel le Faou, Varennes Vauzelles; Henri Peyre, Nevers, all of France

[73] Assignee: Ste LOOK, Nevers, France

[21] Appl. No.: 455,579

[22] Filed: Jan. 4, 1983

[30] Foreign Application Priority Data

Jan. 26, 1982 [FR] France ..... 82 01146

[51] Int. Cl.[3] ..... A63C 7/10

[52] U.S. Cl. ..... 280/605

[58] Field of Search ..... 280/605, 12 AB; 188/5, 188/7

[56] References Cited

U.S. PATENT DOCUMENTS

| | | | |
|---|---|---|---|
| 3,989,271 | 11/1976 | Riedel | 280/605 |
| 4,266,801 | 5/1981 | Salomon | 280/605 |
| 4,266,804 | 5/1981 | Murata | 280/605 |
| 4,383,699 | 5/1983 | Beyl | 280/605 |
| 4,383,700 | 5/1983 | Beyl | 280/605 |
| 4,403,788 | 9/1983 | Bernard et al. | 280/605 |

FOREIGN PATENT DOCUMENTS

| | | |
|---|---|---|
| 2228506 | 12/1974 | France . |
| 2308389 | 11/1976 | France . |
| 2330419 | 6/1977 | France . |

*Primary Examiner*—Richard A. Bertsch

*Attorney, Agent, or Firm*—Young & Thompson

[57] ABSTRACT

A pivotal control flap carried by the top section of one ski-braking arm is connected to an identical flap carried by the other braking arm by means of a top arcuate member. Each flap has two separate bores forming swivel-bearings respectively for the top section of the corresponding arm and for the respective leg of the arcuate connecting member. The angle made by the bores with respect to each other is such that the pivotal displacement of the two flaps under the pressure of the ski boot produces a movement of relative inward withdrawal of the bottom sections of the braking arms when they are in the raised position.

2 Claims, 7 Drawing Figures

SKI BRAKE

This invention relates to ski brakes fitted with two braking arms placed on each side of the ski and subjected to the action of a spring which tends to restore said arms to their active position.

In ski brakes of this type, each braking arm can advantageously consist of a wire which is suitably elbowed so as to form a bottom section adapted to carry a braking shoe, an intermediate section pivotally mounted on the ski, and a top section which is subjected to the pressure of the ski boot when this latter is in position.

As a general rule, the upper end of the two braking arms thus formed carries an operating pedal or like element on which the ski boot is applied when it is positioned on the ski. Thus the ski boot automatically causes pivotal displacement of the braking arms to their raised position of rest. Under the action of the restoring spring, however, the braking arms open-out immediately after release of the ski boot.

Some types of ski brakes are provided with means for producing a movement of relative inward withdrawal of the braking shoes in the raised position so as to ensure that the shoes do not project from the sides of the ski.

Thus in French patent application No. 76 11752 granted under No. 2,308,389, relative inward withdrawal of the braking arms in the raised position is produced by exerting pressure on a small deformable plate or articulated quadrilateral placed beneath the ski-boot location in order to be flattened by this latter at the time of positioning. The arrangement is such that flattening of said small plate or of said articulated quadrilateral then causes the two braking arms to move towards each other after they have been lifted to their position of withdrawal.

However, if the control plate is a curved strip, the strip exerts a high pressure beneath the ski boot and is thus liable to interfere with the conditions of ski-boot disengagement at the time of release of the binding which retains the boot on the ski. Moreover, if the control plate consists of an articulated quadrilateral, the system provided is particularly complicated and costly. This system is also unreliable, all the more so as its operation is sensitive to frost.

In French patent application No. 75 34137 granted under No. 2,330,419, relative inward withdrawal of the braking arms is obtained by means of the action of one or a number of ramps which can be carried by an auxiliary pedal. But in this case also, the solutions contemplated are not satisfactory. Since inward withdrawal of the braking arms is obtained as a result of deformation of the wire which constitutes said arms, it is in fact necessary to exert a very large force in order to achieve this result. Furthermore, this system also gives rise to parasitic stresses which interfere with the conditions of disengagement of the ski boot in the event of release of the ski binding.

Furthermore, in order to prevent excessive bulk of the braking system, it is necessary to limit the height of the control ramps, thus limiting the amplitude of inward withdrawal of the braking arms.

In yet another design solution, inward withdrawal of a braking arm can be obtained by causing this latter to pivot within a bearing whose axis is located in a plane which is transverse with respect to the ski and inclined with respect to the top face of this latter (as shown in FIG. 11 of French patent application No. 73 17074 published under No. 2,228,506). A system of this type has the advantage of being extremely simple. In contrast, it has a disadvantage in that the least deformation of the braking arm is liable to cause frictional contact and even jamming against the side face of the ski since relative inward withdrawal of the arms takes place at the same time as their upward displacement. A further disadvantage lies in the fact that, in order to obtain a movement of inward withdrawal over a sufficient distance, it is necessary to ensure that the swivel-bearing is located at a relatively high level, which is unacceptable if the brake is placed beneath the ski boot.

Broadly speaking, most of the systems proposed up to the present time for causing relative inward withdrawal of the braking arms are subject to major disadvantages. It is for this reason that the aim of the present invention is to provide a ski brake in which relative inward withdrawal of the braking arms is obtained by means of a simple, reliable and inexpensive system which exerts a negligible parasitic thrust beneath the ski boot.

Said ski brake is essentially distinguished by the fact that the top section of each braking arm is adapted to carry a pivotal control flap connected to the flap of the top section of the other braking arm by means of a top arcuate member and that each flap is provided with two separate bores which serve as swivel-bearings respectively for the top section of the corresponding arm and for the respective arm of the top arcuate connecting member. The angle made by said bores with respect to each other is such that the pivotal displacement of the two flaps about the legs of the top arcuate connecting member under the action of the pressure exerted by the ski boot causes the bottom sections of the braking arms to move towards each other.

Thus the shoes of the braking arms are automatically withdrawn inwards when they are in the raised position, thus preventing said braking shoes from projecting outwards on each side of the ski.

Other features of the invention will be more apparent upon consideration of the following description and accompanying drawings, wherein.

Figure 1:
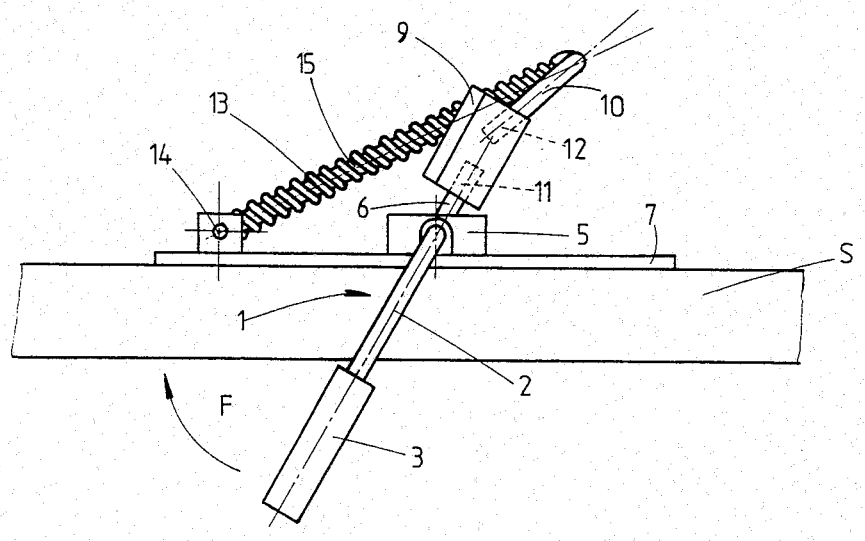
FIG. 1 is a view in side elevation showing the ski brake in the braking position.

Said ski brake comprises two braking arms 1 placed symmetrically with respect to the longitudinal midplane of the ski S. Each braking arm is elbowed in one plane so as to form a bottom section 2 which carries a braking shoe 3, an intermediate section 4 pivotally mounted within a bearing 5, and a top control section 6. The two bearings 5 are carried by a plate 7 which serves as a base for mounting the braking system on the ski S by means of screws 8. These two bearings are so arranged as to define a transverse axis X-Y for the pivotal displacement of the two braking arms 1. A point worthy of note, however, is that the intermediate sections 4 of said braking arms are provided with a certain amount of play within said bearings.

The top section 6 of each braking arm is adapted to carry a pivotal control flap 9 and the two flaps thus provided as well as the braking arms 1 are joined together by means of a top arcuate member 10 of wire.

Each flap 9 has two separate bores 11 and 12 which serve as swivel-bearings respectively for the end of the top section of the corresponding arm and for the respective arm of the arcuate connecting member 10. In actual practice, the axes of said bores are neither in the line of extension of each other nor parallel. The angle between said axes is such that, when the two flaps 9 are folded-back in a flat position against the ski as a result of pivotal displacement about the two legs of the top arcuate connecting member 10, the intermediate sections 4 of the braking arms 1 undergo a movement of angular displacement within the bearings 5 and move the braking arms 3 towards each other.

The return movement of the pivotal arms 1 to their active braking position is carried out by means of a helical tension spring 13, one end of which is attached to the elbow of the top arcuate connecting member 10 whilst the opposite end of said spring is attached to a stationary pin 14 carried by the mounting plate 7.

A rod 15 is placed within the interior of said spring and has a length such that said rod serves as a stop for limiting the extent of downward pivotal displacement required for the braking action.

Thus at the end of the movement of downward pivotal displacement of said arms, the top connecting member 10 comes up against the corresponding end of the rod 15 whilst the opposite end of said rod is abuttingly applied against the stationary pin 14. This accordingly provides a very simple means for limiting the downward opening movement of the braking arms in a highly effective manner since the rod 15 constitutes a virtual prop between the top arcuate connecting member 10 and the ski.

Figure 2:
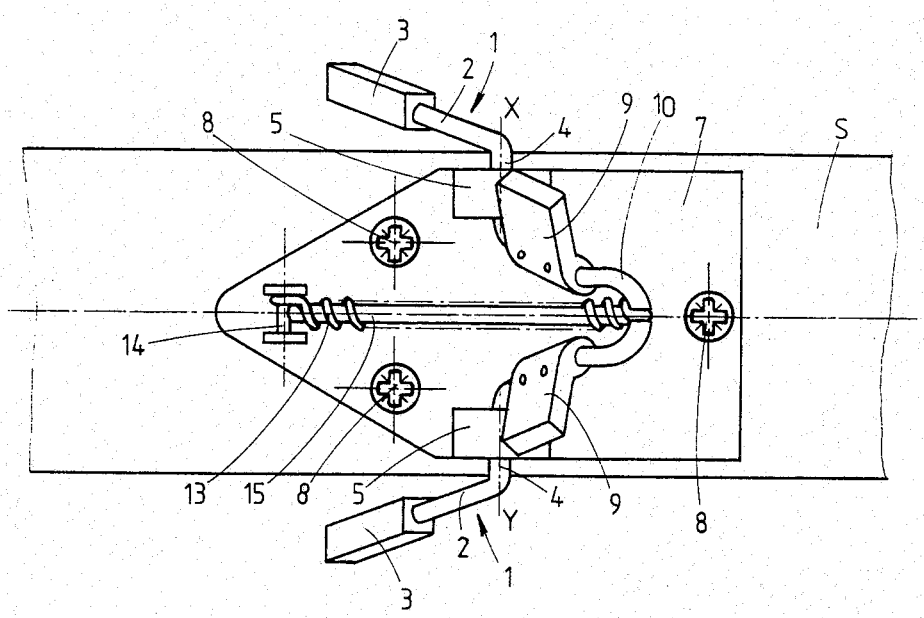
FIG. 2 is a corresponding overhead plan view.

In the active position of the braking arms, the braking shoes are placed on each side of the edge faces as shown in FIGS. 1 and 2. In the same active position, the two outer ends of the control flaps 9 are raised to a slight extent.

When the ski boot is fitted in position, the sole of the boot is brought to bear on said two flaps, thus first producing a pivotal displacement of the braking arms in the direction of the arrow F as a result of rotation of the intermediate sections 4 within the bearings 5. This pivotal movement continues until the top arcuate connecting member 10 is abuttingly applied against the top face of the ski and the braking shoes 3 are lifted above the level of the top surface of the ski.

Figure 3:
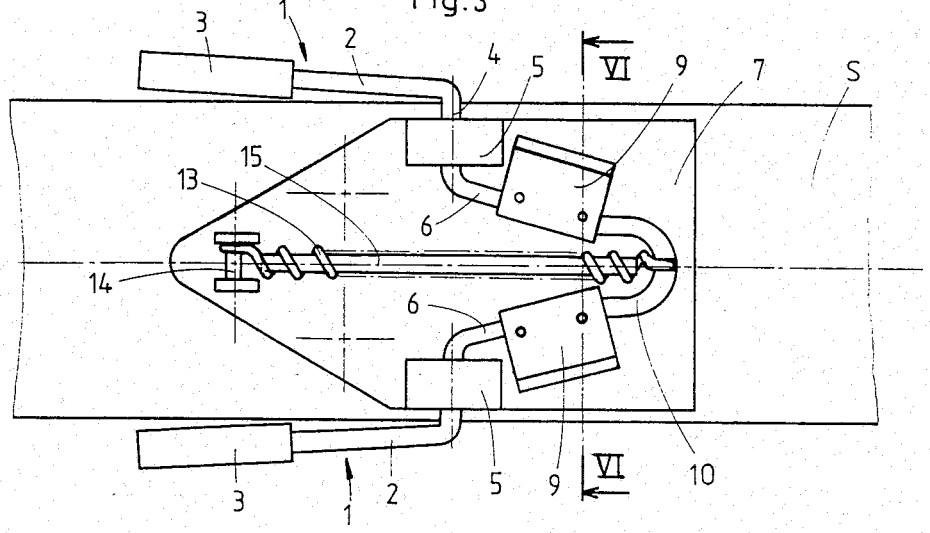
FIG. 3 is an overhead plan view showing the ski brake in the intermediate position in which the braking shoes have been moved to the uplifted position but have not yet been withdrawn inwards.
Figure 5:
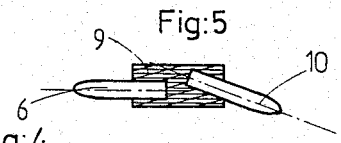
FIG. 5 is a part-sectional view taken along line V—V of FIG. 4.
Figure 6:
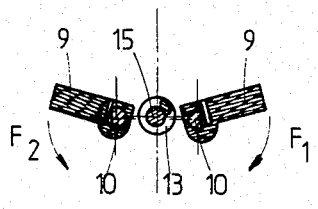
FIG. 6 is a part-sectional view taken along line VI—VI of FIG. 3.
Figure 7:
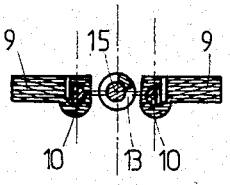
FIG. 7 is a part-sectional view taken along line VII—VII of FIG. 4.

In this position and as illustrated in FIG. 3, the two flaps 9 continue to be raised at the outer end and to form a dihedron as shown in FIG. 6. However, the pressure which continues to be exerted by the ski boot on said two flaps causes these latter to undergo a movement of pivotal displacement in the direction of the arrows F1 and F2 about the legs of the top arcuate connecting member 10 until said flaps are placed flat against the ski as shown in FIG. 7.

In point of fact, the pivotal movement of each control flap has the effect of exerting an inward tractive force on the corresponding braking arm. This results in a relative inward withdrawal of the braking shoes to the position shown in FIG. 4 in which said shoes are set back with respect to the edge faces of the ski.

Figure 4:
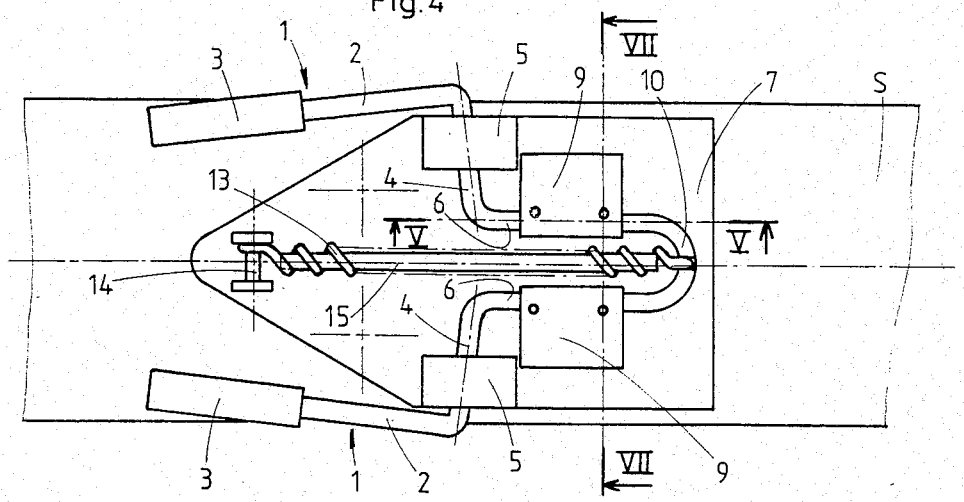
FIG. 4 is an overhead plan view showing the inactive position of readiness in which the braking arms are both fully raised and inwardly withdrawn.

The particular movement of angular displacement thus performed by the two braking arms is very clearly apparent from a comparison of FIGS. 3 and 4. As can readily be understood, this movement is made possible by the fact that the intermediate sections 4 are endowed with a certain play within the bearings 5.

Furthermore, said movement is accompanied by a slight displacement of the arcuate connecting member 10 against the ski in opposition to the action of the spring 13. In consequence, when the ski boot is released and no longer bears on the flaps 9, the tractive force exerted by the spring 13 first has the effect of lifting the flaps and therefore of causing outward displacement of the braking shoes which are then capable of passing on each side of the ski in order to pivot downwards to their work position.

The movements of the braking arms must necessarily be broken down into two stages in order to prevent any risk of accidental catching of said arms against the sides of the ski at the time of opening-out and downward pivotal displacement as well as at the time of upward return.

The main advantage of the ski brake in accordance with the invention lies in the simplicity and effectiveness of the means provided for ensuring relative inward withdrawal of the braking shoes in their raised position. It should also be noted in the case under consideration that this inward movement of withdrawal calls for less effort than in the case in which it is obtained by thrusting-back a single operating pedal which undergoes a displacement in pivotal motion about a transverse axis. In the ski brake according to the invention, this inward movement of withdrawal is produced by the downward displacement of the two flaps 9, said flaps being capable of pivotal motion about two axes which extend in a longitudinal direction. This downward displacement therefore calls for a smaller effort and the forces exerted are much more uniformly distributed than in the case of pressure applied on a single pedal. This in fact facilitates positioning of the boot in the corresponding ski binding by virtue of the fact that the final downward displacement of the two control flaps is easier to perform.

What is claimed is:

1. In a ski brake comprising two braking arms placed on each side of the ski, each braking arm being elbowed so as to form a bottom section which is adapted to carry a braking shoe, an intermediate section pivotally mounted on the ski with a predetermined degree of play in a transverse bearing fixed on the ski and a top section subjected to the pressure of the ski boot when said boot is in position; the improvement comprising a pivotal control flap carried by the top section of each braking arm, and a top arcuate connecting member having two legs one of which legs is connected to each of said flaps, each said flap having two separate bores which are inclined at an angle with respect to each other and serve as swivel-bearings respectively for said top section of the corresponding braking arm and for the respective leg of said top arcuate connecting member.

2. A ski brake according to claim 1, wherein the braking arms are restored to their active position by means of a helical tension spring attached at one end to the top arcuate connecting member and at the other end to the top face of the ski, a rod forming a stop for said top arcuate connecting member being placed within said helical spring in order to limit the extent of downward pivotal displacement of said braking arms.

* * * * *